United States Patent [19]

Kösters

[11] Patent Number: 4,889,182

[45] Date of Patent: Dec. 26, 1989

[54] HEAT EXCHANGER

[75] Inventor: Peter H. Kösters, Magrette 1a, Netherlands

[73] Assignee: The Dow Chemical Company, Midland, Mich.

[21] Appl. No.: 711,927

[22] Filed: Mar. 15, 1985

Related U.S. Application Data

[63] Continuation-in-part of Ser. No. 405,213, Aug. 4, 1982, abandoned.

[51] Int. Cl.[4] ..... F28F 19/00; F28F 13/00; F28D 7/12

[52] U.S. Cl. ..... 165/134.1; 165/135; 165/142; 165/162; 122/305

[58] Field of Search ..... 165/134.1, 142, 135, 165/162; 122/305, 318, 319, 320

[56] References Cited

U.S. PATENT DOCUMENTS

| | | | |
|---|---|---|---|
| 2,834,581 | 5/1958 | Schefels et al. | 165/135 |
| 3,244,226 | 4/1966 | Hettrich, Jr. | 165/135 |
| 3,446,277 | 5/1969 | White | 165/142 |
| 3,610,328 | 10/1971 | LaRue | 165/134.1 |
| 3,895,674 | 7/1975 | Harris | 165/134.1 |
| 4,098,587 | 7/1978 | Krar et al. | 165/134.1 |
| 4,098,588 | 7/1978 | Buswell et al. | 165/142 |
| 4,222,824 | 9/1980 | Flockenhaus et al. | 165/142 |
| 4,224,982 | 9/1980 | Frei | 165/134.1 |
| 4,248,834 | 2/1981 | Tokumitsu | 165/135 |
| 4,431,049 | 2/1984 | Zamma et al. | 165/142 |

FOREIGN PATENT DOCUMENTS

| | | | |
|---|---|---|---|
| 1205121 | 11/1965 | Fed. Rep. of Germany | 165/134 R |
| 195018 | 6/1967 | U.S.S.R. | 165/142 |
| 2062834 | 5/1981 | United Kingdom | 165/1 |

*Primary Examiner*—John Ford
*Attorney, Agent, or Firm*—V. Dean Clausen

[57] ABSTRACT

The heat exchanger disclosed herein includes a head section and a heat exchanging section. The heat exchanging section consists of a bundle of inner conduits, open at both ends, and a bundle of outer conduits, open only at one end. The outer conduits enclose that part of the inner conduits within the heat exchanging section, such that an annular space is defined between the conduits. In operation, a lower temperature fluid is introduced into the head section, which generally operates at low temperature and high pressure. The lower temperature fluid flows through the inner conduits into the heat exchanging section and returns to the head section through the annular spaces between the inner and outer conduits. The high temperature fluid flows through the heat exchanging section in intimate contact with the conduits containing the lower temperature fluid, so that it is cooled by the lower temperature fluid. The head section of the heat exchanger is protected against the high temperatures in the heat exchanging section by a temperature adjustment zone, which thermally separates the head and heat exchanging sections.

3 Claims, 6 Drawing Sheets

HEAT EXCHANGER

CROSS REFERENCE TO RELATED APPLICATION

This is a continuation-in-part of application Ser. No. 405,213, filed Aug. 4, 1982, now abandoned.

BACKGROUND OF THE INVENTION

Broadly, the invention relates to a heat exchanger for cooling a fluid, at a given temperature and pressure, with a second fluid at a lower temperature and higher pressure.

In conventional shell-and-tube heat exchangers, the tube section of the heat exchanger consists of a bundle of tubes which are open at both ends. At each end, the tubes extend through and are welded to a tube sheet. The shell of the heat exchanger completely encloses the bundle. The tubes within the bundle are spaced apart from each other, and from the shell, to define the shell-side section of the heat exchanger.

In a typical heat exchanging operation, one of the fluids (liquid or gas) is passed through the tube section of the heat exchanger. The other fluid is then passed through the shell section, that is, on the the outside of the tubes, usually in a flow path which is countercurrent to the fluid flowing through the tube section. An example of a heat exchanging operation is the cooling of the reaction product from a hydrocarbon cracking furnace. The reaction product is usually a gas which exits from the cracking furnace at a temperature of from about 700°-900° C. As the hot gas leaves the furnace, it is passed through the tube section of the heat exchanger, and cooled by a second fluid, generally water at high pressures, which is passed through the shell section of the heat exchanger. In this operation, part of the heat from the higher temperature gas (reaction product) is transferred through the tube walls to the water. The overall effect is to raise the temperature of the water, sometimes enough to vaporize it, and to reduce the temperature of the gas.

The heat exchangers employed in the cracking process described above have several disadvantages. For example, the deposition of coke on the surface of the tube walls causes fouling of the heat exchanger, and seriously impairs the effectiveness of the heat exchanging operations. When coke build-up occurs, the cleaning operation requires manual washing of the interior of the tubes, as well as a lengthy shut-down of the upstream system. Not only must the cleaning operation be performed frequently, but the heat exchanger can be out of operation for as long as a week. Another problem is the possibility of damage to the heat exchanger tubes due to temperature cycling during cleaning. For example, the heat exchanger must be cooled from a fairly high operating temperature to a fairly low temperature, for the cleaning step and then the temperature must be raised again to resume the heat exchange operation.

Conventional shell-and-tube heat exchangers have been modified in various ways in attempts to improve the efficiency of the heat exchange operation, and/or to reduce the mechanical stresses described above. One of these modifications is described by H. R. Knulle, in "Problems With Exchangers in Ethylene Plants", *Chemical Engineering Progress,* Volume 68 No. 7 (July 1972), pp. 53-56. This heat exchanger is a double tube construction in which pyrolysis gas, flowing through an inner tube, is cooled by another fluid, which flows through an outer tube enclosing the inner tube. Heat exchangers of this type, as well as many other known exchangers, are difficult to clean, since they require manual washing and a substantial amount of shut-down time. In addition, the exchanger must be cooled prior to cleaning, so that it is not subject to damage from the temperature cycling sequence described above.

The heat exchanger of this invention has several distinct advantages over the known methods and apparatus for exchanging heat between fluids. For example, a fluid at a relatively high temperature can be quickly cooled to a lower temperature. This is a particular advantage in hydrocarbon cracking operations, such as thermal or catalytic cracking reactors, in which the hot reaction product must be quickly cooled to eliminate undesirable by-products. Using the heat exchanger of this invention, the hot reaction product, which generally has a temperature of about 700°-1000° C., can be cooled to below about 500°-700° C. in about 0.03 seconds.

Another advantage of the present heat exchanger is its ability to gradually dissipate relatively high temperatures, which are present in the heat exchanging section, in the direction of the head section, which normally operates at lower temperatures and higher pressures. Dissipation of the heat in this manner eliminates the problem of material degradation, which usually occurs in exchangers where a high temperature zone borders a low temperature zone. Another advantage is that the time required to clean the present heat exchanger is considerably less than that required for conventional heat exchangers. For example, cleaning time generally requires only a few hours. Still another advantage is that the present heat exchanger can be cleaned while it is "on-line", that is, it does not have to be cooled down prior to cleaning. This feature greatly reduces the possibility of thermal degradation of the tubes and other parts of the exchanger from the temperature cycling sequence described earlier.

SUMMARY OF THE INVENTION

The heat exchanger of this invention is designed for cooling a first fluid, at a given temperature and pressure, with a second fluid, at a lower temperature and pressure. Basically, the heat exchanger comprises a head section and a heat exchanging section. The head section includes an inlet and an outlet for the lower temperature fluid. The heat exchanging section consists of a bundle of inner conduits and outer conduits. The outer conduits, which are open at both ends, extend from the head section to the heat exchanging section. These conduits are in fluid communication with the inlet in the head section, so that the lower temperature fluid can pass through the inner conduits.

Each outer conduit encloses that part of an inner conduit which lies within the heat exchanging section, such that a channel is defined between the conduits. The outer conduits are in fluid communication with the outlet in the head section. The channel thus provides a means for the lower temperature fluid, as it exits from the inner conduits, to flow to the outlet in the head section. The heat exchanging section also includes an inlet and an outlet for the first fluid, which is the higher temperature fluid. Inside the heat exchanging section is a space through which the higher temperature fluid can pass as it flows from the inlet to the outlet. During this pass through the heat exchanger, the higher temperature fluid makes contact with the conduits through which the lower temperature fluid is flowing.

A temperature adjustment zone is located between the head section and the heat exchanging section. This zone is adapted for receiving a fluid having a temperature below the temperature of the higher temperature fluid. The lower temperature fluid thus provides a means for gradually reducing the temperature from the heat exchanging section to the head section. In a preferred embodiment, the inner conduits are secured at one end to a first tube sheet and the outer conduits are secured at their open ends to a second tube sheet. Positioned between the head and heat exchanging sections is an insulation packet, which is also adjacent to a closure member located between the second tube sheet and the outlet for the higher temperature fluid. The inner and outer conduits pass through the closure member, with passages being defined between the conduits and the closure member. These passages provide fluid communication between the insulation packet and a cooling fluid.

DESCRIPTION OF THE PREFERRED EMBODIMENTS

Figure 1:
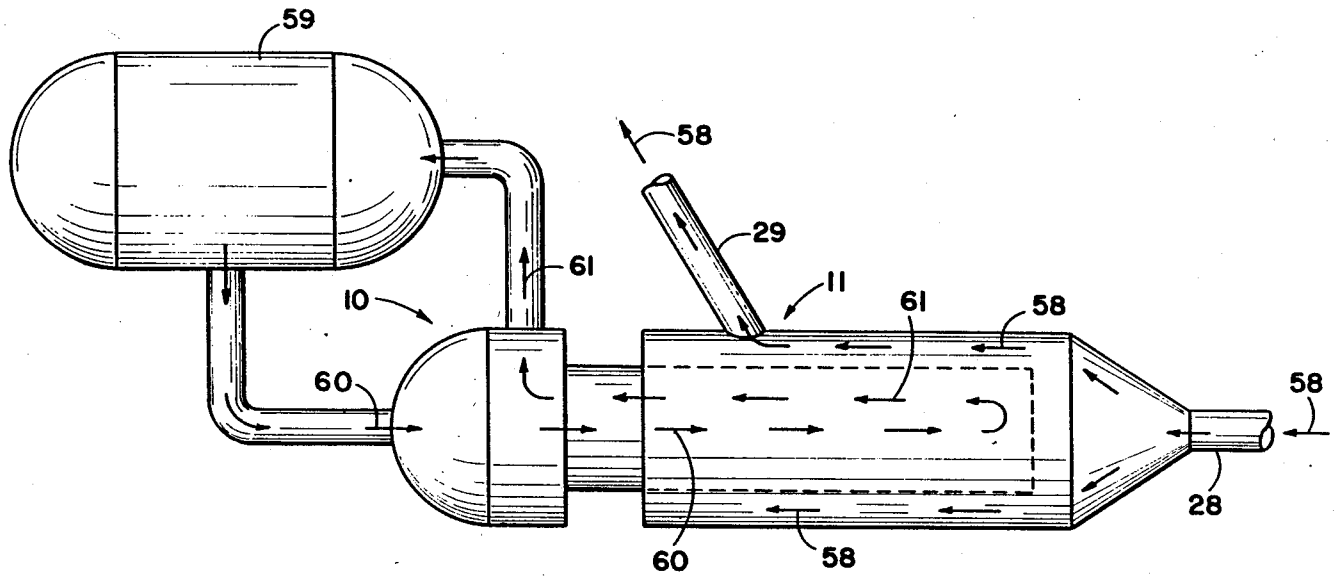
FIG. 1 is a schematic illustration of the heat exchanger of this invention, indicating the flow path of the fluids through the exchanger during a heat exchanging operation.

In the drawing, as shown in FIG. 1, the heat exchanger apparatus of this invention consists primarily of two parts, a head section 10 and a heat exchanging section 11. Referring now to the embodiment shown in FIG. 2, the head section 10 includes an inlet 16, an outlet 17, a first tube sheet 12, and a second tube sheet 13. Tube sheet 12 is a relatively thin structure, for example, about 2 to 10 mm in thickness. Tube sheet 13, however, is generally constructed of a much thicker material, for example, about 10 to 35 mm. The thickness of each tube sheet depends primarily on the pressure differential which is present on each side of the tube sheet. For example, tube sheet 13 is usually constructed of a thicker material than the tube sheet 12, because it is generally exposed to a higher pressure differential during operation of the heat exchanger.

Figure 2:
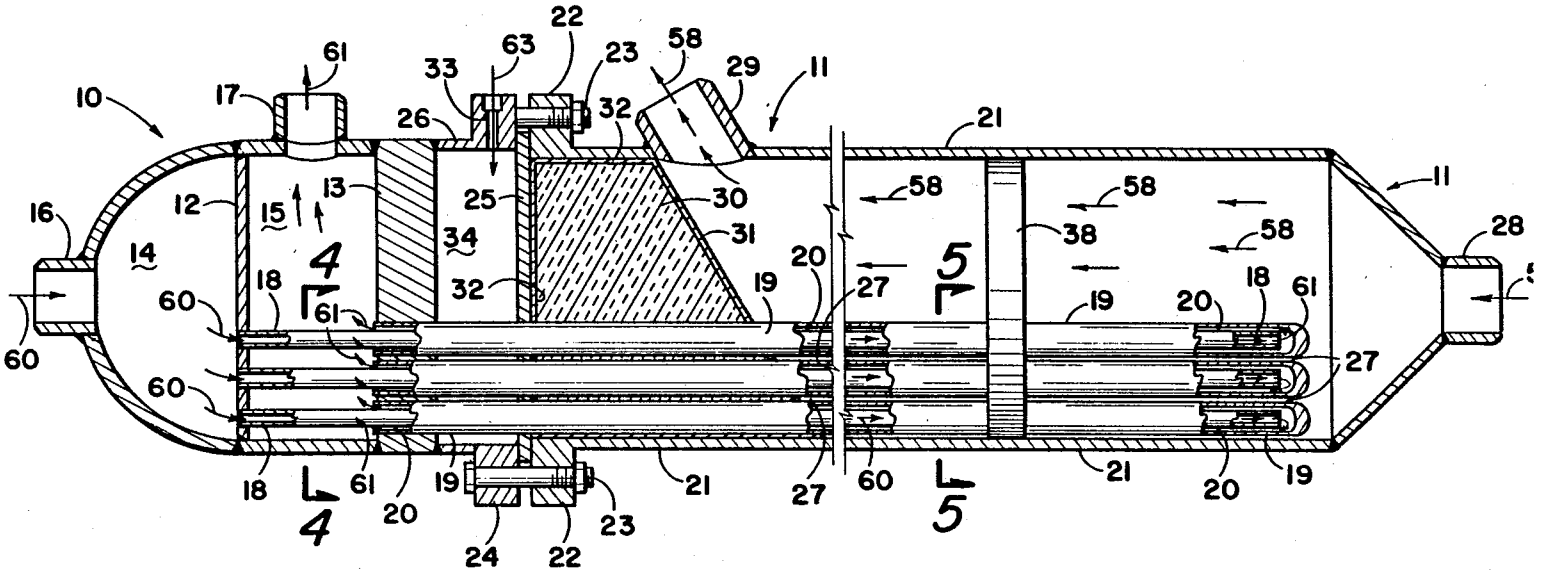
FIG. 2 is a front elevation view, mostly in section, of a specific embodiment of the heat exchanger shown in FIG. 1.

The head section 10 is divided into two separate chambers by the tube sheet 12. Specifically, the space ahead of the tube sheet 12 provides an inlet chamber 14, and the space between tube sheet 12 and tube sheet 13 provides an outlet chamber 15. Inlet 16 provides a means for directing a fluid into the inlet chamber 14. From chamber 14, the fluid passes through a number of inner conduits 18, which are usually referred to as a bundle. Each of the inner conduits 18, which is open at both ends, is secured to the tube sheet 12, by welding, brazing, or other suitable means. In addition, each conduit 18 extends from the head section 10, into the heat exchanging section 11. As shown in FIG. 2, that part of each inner conduit 18, which lies within the heat exchanging section 11, is enclosed by an outer conduit 19.

Figure 4:
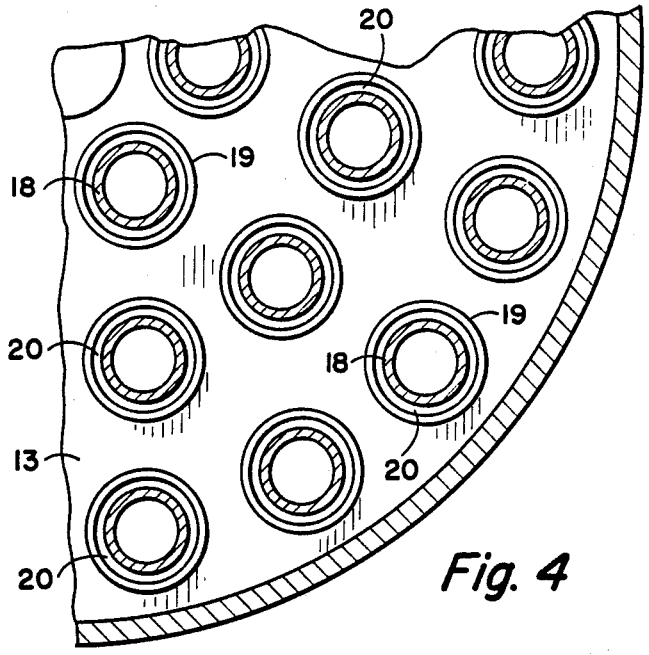
FIG. 4 is a fragmentary cross-sectional view, taken on line 5—5 in FIGS. 2 and 3. This view shows part of the tube sheet and the tube bundle of the heat exchanger.

A channel 20 is provided by an annular space defined between the inner surface of outer conduit 15 and the outer surface of inner conduit 18. The open end of each outer conduit 19 is secured, generally by welding, brazing, or other suitable means, to the second tube sheet 13, so that channel 20 is in fluid communication with outlet chamber 15 and outlet 17 therein. The inner conduits 18 and outer conduits 19 are tubes, which are in concentric relation to each other, as shown in more detail in FIG. 4. In the practice of this invention, the channel 20 between the tubes 18 and 19 provides a passage through which the lower temperature fluid exiting from conduit 18 can flow into the outlet chamber 15, which is bordered on one side by the larger tube sheet 13.

Figure 5:
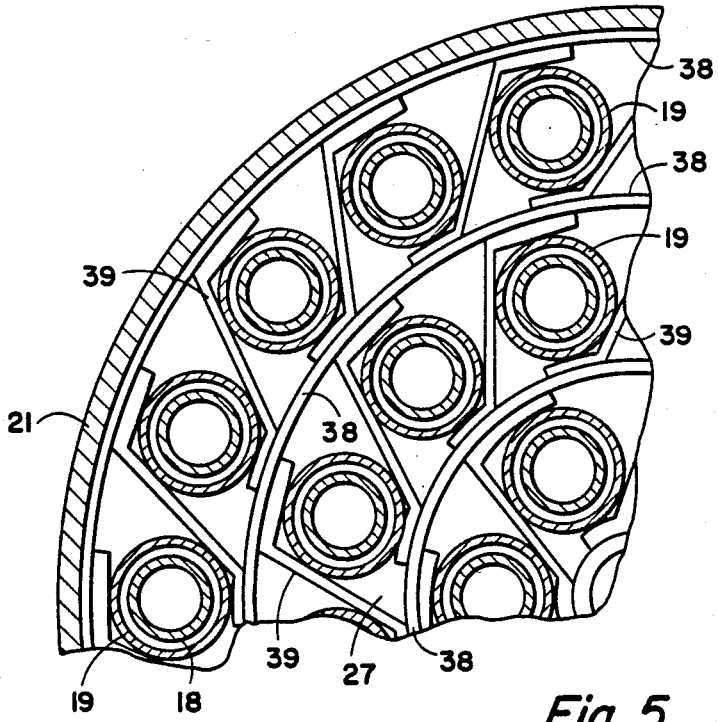
FIG. 5 is a fragmentary cross-sectional view, taken on line 5—5 in FIGS. 2 and 3. This view shows a portion of the tube bundle and the members which support the bundle in the heat exchanging section of the heat exchanger.
Figure 6:
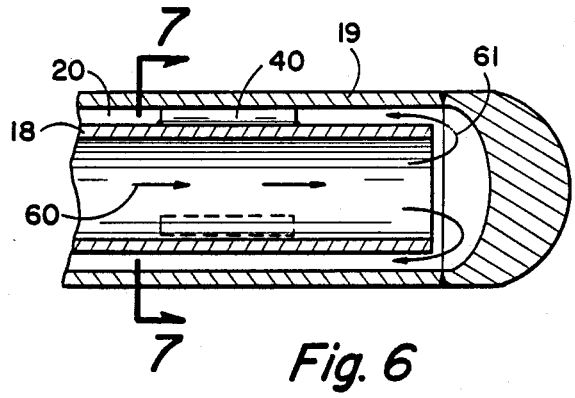
FIG. 6 is a fragmentary detail view, in section, showing the closed end of an outer conduit, in the tube bundle, which has an inner conduit positioned therein and a means for supporting the inner conduit within the outer conduit.
Figure 7:
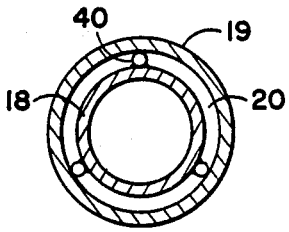
FIG. 7 is a cross-sectional view, taken on line 7—7 of FIG. 6.

As shown in FIGS. 6 and 7, the inner tubes 18 are positioned centrally within the outer tubes 19 and held in place by rods 40. The position and size of rods 40 is such that they do not significantly restrict the flow of fluid through channel 20. The drawings, specifically FIGS. 2, 3, and 8, have been simplified to show the conduits 18 and 19 as occupying only a part of the head section 10 in the heat exchanging section 11. In the actual fabrication of the heat exchanger, as shown best in FIGS. 4 and 5, conduits 18 and 19 occupy most of the cross-sectional area defined within the head and heat exchanging sections.

As shown in FIG. 5, that part of the conduits 19, which extends into the heat exchanging section 11, is preferably supported by some adequate means, such as concentric rings 38. The support means for the outer conduits also includes a number of spaced strut members 39, which are fastened between each of the concentric rings 38. Specifically, the outer conduits 19 are positioned between the rings 38, such that each outer conduit is wedged between adjacent strut members 39.

Referring again to FIG. 2, the heat exchanging section 11, which is defined by boundary wall 21, is the section of the heat exchanger in which heat is transferred from the higher temperature fluid to the lower temperature fluid. The higher temperature fluid enters the heat exchanging section 11 through an inlet 28 and leaves through an outlet 29. Within the heat exchanging section 11, there are narrow spaces 27 defined between each of the outer conduits 19 and between the conduits 19 and the inside of the boundary wall 21. Spaces 27 provide flow passages for the higher temperature fluid to pass through the heat exchanging section 11.

A closure sheet 25 is positioned between a flange 22 and boundary wall 21, and another flange 24, which forms the terminal wall of end wall 26. The flanges are fastened together by bolts 23, so that the closure sheet 25 is secured to the boundary wall 21. Wall 26 is secured to tube sheet 13 by welding, brazing, or other suitable means. The conduits 18 and 19 pass through the closure sheet 25, but are not attached to this sheet. Instead, it is preferred to have a small amount of clearance, (not shown) between the outside of each conduit 19 and the closure sheet 25. This allows the conduits to move freely, that is, to expand or contract in response to temperature changes, and other conditions, without creating undesirable thermal stresses.

Wall 26 provides the necessary connection between the head section 10 and the heat exchanging section 11. In practice, the wall 26 must be thin enough (not more than 15 mm) to miminize heat transfer from the heat exchanging section to the head section; but it must be thick enough to rigidly connect the head section to the heat exchanging section. Since the closure sheet 25 is not fastened to boundary wall 21, or to thin wall 26, by mechanical means or otherwise, the thermal stresses in the heat exchanger are reduced even further. The head section 10 is further insulated from the high temperature of the heat exchanging section 11 by a cooling fluid chamber 34, which functions as a thermal sleeve. As illustrated in FIG. 2, chamber 34 is a space defined between tube sheet 13 and closure member 25, and which is enclosed by connecting wall 26. An inlet 33, which extends through the top part of flange 24, provides a means for directing a cooling and purging fluid (hereafter referred to as a "cooling fluid") into chamber 34. Inlet 33 is positioned in flange 24, rather than in the thin wall 26, to prevent excessive mechanical and thermal stresses in the wall 26.

The cooling fluid chamber 34 is in fluid communication with a means which provides for uniformly distributing the cooling fluid over the entire cross-sectional area defined by boundary wall 21. As illustrated in FIG. 2, an insulation material 30 is disposed within an area defined by impingement plate 31, wall members 32 and closure member 25. Fluid communication between the insulation material 30 and cooling fluid chamber 34 is provided by apertures (not shown) between outer conduits 19 and closure member 25, and between the outer conduits and wall members 32. Although the insulation material 30 helps to insulate closure member 25 from the high temperatures in the heat exchanging section, and it provides a more uniform distribution of the cooling fluid over the entire available cross-sectional area, its use is optional. When a heat-insulating material is used, the preferred materials are compressed mineral wool, aluminum oxide fibers, Kaowool® alumina-silica ceramic fibers, or the like. Impingement plate 31 and wall member 32 are constructed of a thin sheet of heat resistant metal or other conventional heat resistant material.

The heat exchanger of the present invention may be used in a wide variety of heat exchange operations. For example, the higher temperature and lower temperature fluids can be gases, liquids, or mixtures of gases and liquids. In general, the higher temperature fluid is normally a hot gaseous material, while the lower temperature fluid is a cooler liquid and/or gaseous material. In some heat exchange operations, it may be desirable for the lower and/or higher temperature fluid to undergo a phase change as the fluids move through the heat exchanger. For example, it is often preferable for a lower temperature liquid to vaporize when cooling a higher temperature fluid. Such phase change can be easily accomplished during the operation by selecting the lower temperature and/or higher temperature fluid which exhibits the desired phase change at the actual conditions of operation.

The heat exchange operation of this invention is particularly useful in cooling the hot reaction product from a thermal or catalytic cracking reactor. The temperature of such a reaction product generally varies from 700°–1000° C. In such operations, the lower temperature fluid is preferably an aqueous liquid, usually water. In general, the water should have a temperature of from about 100°–400° C. In the heat exchanging operation, the head section 10 is generally exposed to high pressures and low temperatures, while the heat exchanging section 11 is exposed to the generally higher temperatures and lower pressures of the higher temperature fluid. Heat exchange occurs by the transfer of heat from the higher temperature fluid to the lower temperature fluid.

Refering to FIGS. 1 and 2, a typical heat exchanging operation involves passing the higher temperature fluid into the exchanging section 11 through inlet 28. Inside the heat exchanging section, the higher temperature fluid flows through spaces 27 between the conduits 19, in the direction indicated by arrows 58. At the opposite end of the heat exchanger, a lower temperature fluid, such as water, is passed from a suitable source, such as steam drum 59, through inlet 16 into head section 10. From the head section 10, the lower temperature fluid flows through the inner conduits 18 (for example, tubes) open at both ends, into the heat exchanging section 11. The flow path of the lower temperature fluid is indicated by numeral 60. That part of each inner conduit 18, which lies within the heat exchanging section 11, is enclosed by an outer conduit 19. As illustrated in FIG. 6, the lower temperature fluid, which exits from the inner conduit 18, flows to the head section 10 through a channel 20 formed by the inner surface of outer conduit 19 and the outer surface of inner conduit 18.

When the lower temperature fluid is water, the heat transferred from the high temperature fluid is generally sufficient to vaporize at least a portion of the water to steam. This liquid water-steam mixture, which is generated during the heat exchange operation, flows through the channels 20 to head section 10, along the flow path indicated by numeral 61. From head section 10, the water-steam mixture is recycled through steam drum 59 (flow path 61). As the higher temperature fluid flows through the heat exchanging section 11, along the flow path indicated by numeral 58, it loses heat to the lower temperature fluid. After the higher temperature fluid is cooled, it passes through the product outlet 29.

During operation of the heat exchanger, the combination of the insulation packet 30 and the cooling fluid protects the closure sheet 25 from extreme temperatures and temperature changes, and from corrosion or fouling. A wide variety of fluids are suitable for the cooling fluid. Steam is representative of a cooling fluid which may be used. At outlet 29, the temperature of the cooling fluid is below that of the higher temperature fluid, but the pressure of the cooling fluid is greater than than of the higher temperature fluid. In FIG. 2, the flow path of the cooling fluid is indicated by arrows 63. As described earlier, apertures (not shown) exist between the closure member 25, wall members 32, and the outer conduits 19. These apertures provide flow passages for the cooling fluid to flow into the insulation packet 30 from chamber 34.

Because the pressure of the cooling fluid is greater than the pressure of the higher temperature fluid, the cooling fluid not only flows from chamber 34 into the insulation packet 30, but it flows beyond the insulation packet into the heat exchanging section 11. From the heat exchanging section 11, the cooling fluid is discharged, along with the higher temperature fluid, through the product outlet 29. In the operation of the present heat exchanger, therefore, the high temperatures in the heat exchanging section are gradually dissipated in the direction of the head section. This feature of the present heat exchanger gives it a distinct advantage over the known heat exchangers. To be specific, this heat exchanger does not have the materials of construction problem of the known heat exchangers, due to extreme temperature and pressure differentials between the higher and lower temperature fluids.

In many operations, for example, the cooling of hot reaction products from a thermal or catalytic cracking reactor, it is often desirable to further reduce the temperature of the higher temperature fluid after it flows through product outlet 29, but before it is recovered as the final product. In the practice of this invention, the temperature is further reduced by quenching the higher temperature fluid in a second heat exchanger of the type described herein (not shown) or a different type of exchanger. The temperature of the reaction product from a hydrocarbon cracking reactor, as it exits through product outlet 29, is generally from about 300°-700° C. In the practice of this invention, the reaction product is cooled to below 200°-400° C. in the second heat exchanger (not shown).

The heat exchanger of the present invention can be cleaned by a simple and easy procedure, which involves merely replacing the high temperature fluid with superheated steam and shutting off the supply of the lower temperature fluid. For example, in cleaning or decoking a heat exchanger used in cooling the reaction product from a hydrocarbon cracking reactor, superheated steam, at a temperature of from about 900°-1100° C., is fed through inlet 28. At the same time, the flow of purge fluid through inlet 33 is maintained to protect the head section 10 from extreme temperatures. In such decoking procedures, the temperature adjustment zone sufficiently segregates the heat exchanging section and the head section, so that the temperature in the head section is generally maintained at less than about 500° C., and preferably from about 300° to 400° C. After the superheated steam exits from outlet 29, it is cooled to from 300°-700° C. by the injection of water. The steam can be cooled further by using conventional techniques. Since the heat exchanger of this invention remains at its normal operating temperatures continuously, the thermal stresses usually associated with the cleaning of a heat exchanger (due to temperature cycling) are considerably reduced.

Figure 3:
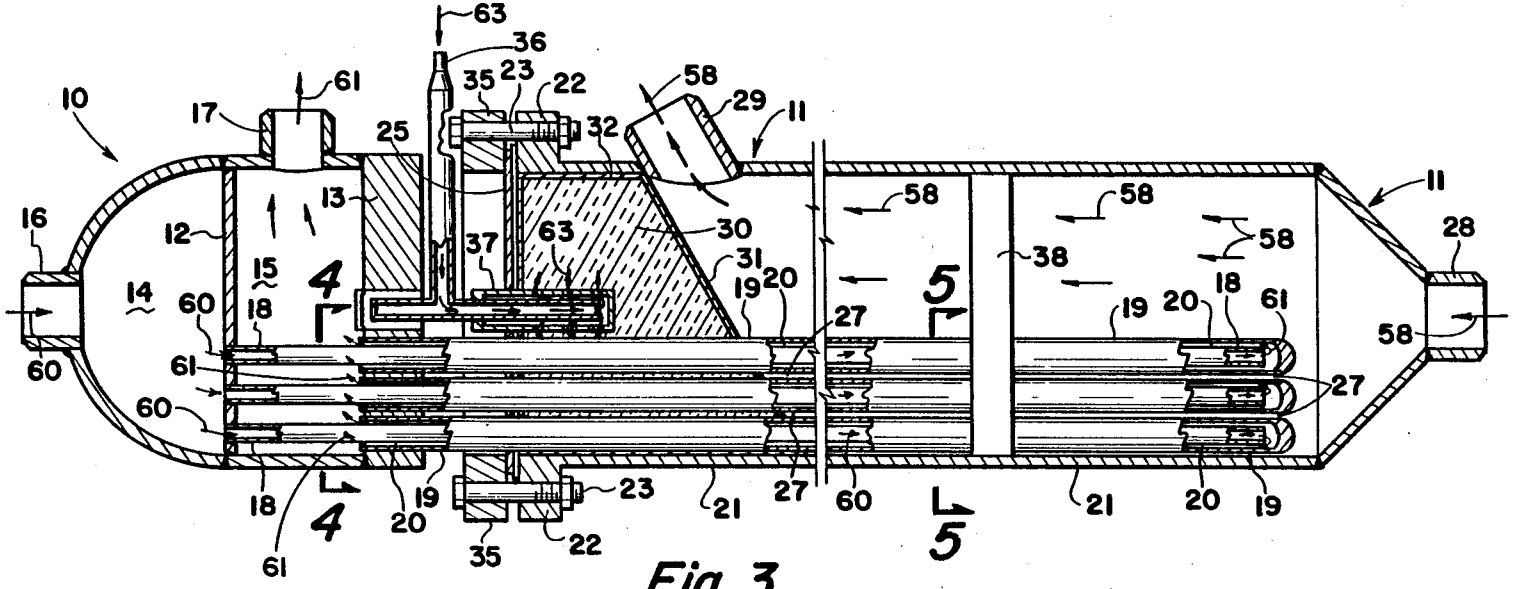
FIG. 3 is a front elevation view, mostly in section, of another specific embodiment of the heat exchanger shown in FIG. 1.

Another embodiment of the heat exchanger of this invention is illustrated in FIG. 3. The head section, the heat exchanging section, and the heat exchange operation are substantially identical to those described for the heat exchanger illustrated in FIG. 2. The same reference numerals are used to designate similar components in each embodiment. In the embodiment of FIG. 3, however, the outer conduits 19 are physically secured to both the second tube sheet 13 and the closure member 25, by welding, brazing, or other suitable means. This construction provides the necessary attachment between the head section and the heat exchanging section, so that there is no need for the thin wall 26. The closure member 25 is positioned between a suitable securing means, such as a flange 22 and an outer clamping member 35, and is clamped in place by bolts 23. Since the closure member 25 in this embodiment (FIG. 3) is not rigidly attached to the securing means, it can move. This enables it to expand or contract when exposed to temperature variation without causing undue stresses (in the same manner as the closure member 25 in the embodiment of FIG. 2).

Between the closure member 25 and the second tube sheet 13, is a space which is preferably open to the environment. Positioned in this space is a cooling fluid inlet conduit 36, for directing the cooling fluid into the heat exchanging section 11. As shown in FIG. 3, the inlet conduit 36 is in the shape of a T, which includes one side arm with an open end and one side arm with a closed end. The open end side arm passes through the closure sheet 25 and is at least partially enclosed by a sleeve 37. The open end side arm also has a number of small openings therein, which open into sleeve 37. Sleeve 37 also has a number of small openings therein, which allow the cooling fluid to flow into the insulation material 30. The side arms of conduit 36 and sleeve 37 are preferably located in the center of the bundle of conduits which carry the lower temperature fluid. In addition, the side arm structure also extends lengthwise through the heat exchanger, to enable a cooling fluid to be uniformly distributed through the insulation material 30.

As illustrated in FIG. 3, the side arm of the cooling fluid inlet 36, which has the closed end, extends into an opening in the second tube sheet 13. This arrangement is optional, but it is preferred because it provides a firmness to the construction of the heat exchanger. Although there are no openings in the wall of this side arm, the arm itself is in fluid communication with the cooling fluid which enters through inlet 36. If the heat exchanger was constructed with a number of side arms extending into the closure member 25, and/or the second tube sheet 13, it would be possible to achieve a more uniform distribution of the cooling fluid through the insulation material 30. However, such a construction is not preferred, since it would decrease the number of conduits available for carrying the lower temperature fluid and thus reduce the capacity of the heat exchanger.

Figure 8:
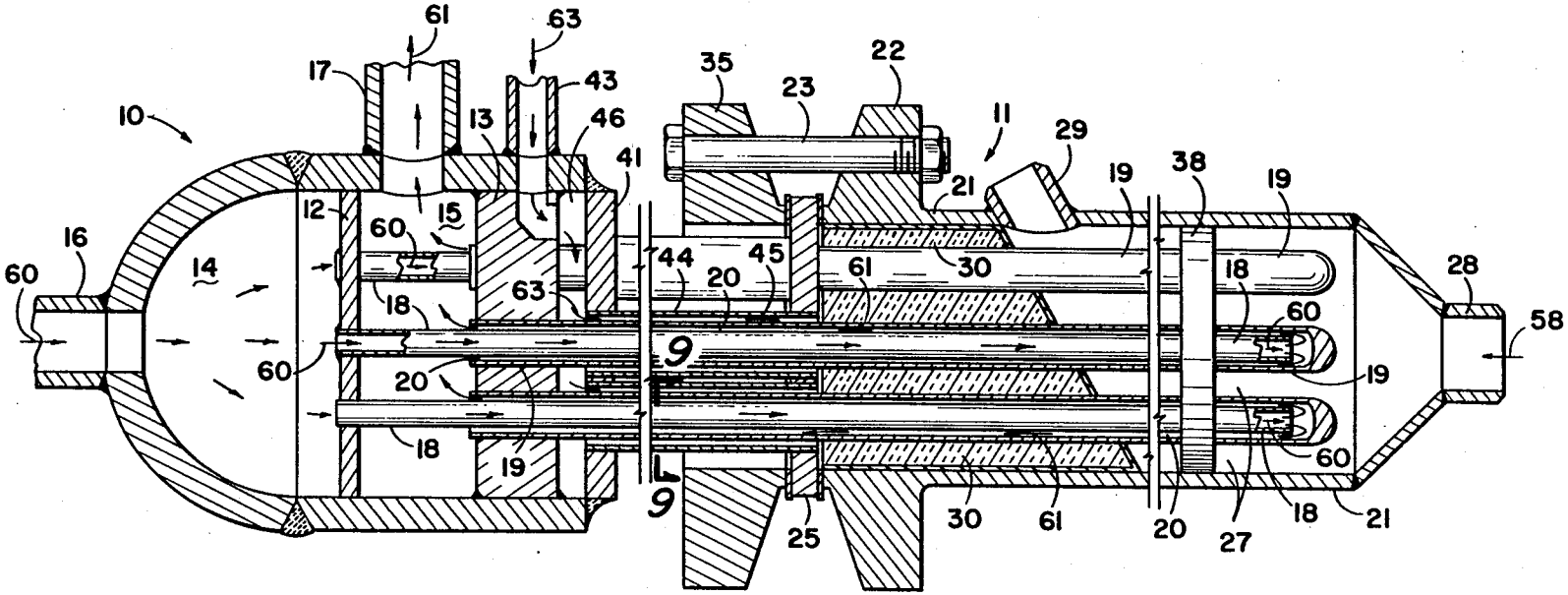
FIG. 8 is a front elevation view, mostly in section of another specific embodiment of the heat exchanger shown in FIG. 1.

Another embodiment of the heat exchanger of this invention is illustrated in FIG. 8. The head section, the heat exchanging section, and the method of operation are substantially identical to the heat exchanger embodiments illustrated in FIG. 2 and 3. The same reference numerals are used to designate similar parts in each embodiment. In the embodiment of FIG. 8, however, a cooling fluid distribution member 41 is provided between the second tube sheet 13 and the closure member 25. A cooling fluid chamber 46 is located between this distribution member 41 and the second tube sheet 13. Cooling fluid enters the heat exchanger through an inlet 43 which communicates with the chamber 46. A closure member 25 is positioned between flanges 35 and 22 and held in place by bolts 23. A number of cooling fluid sleeves 44 are secured at one end to the distribution member 41 and at the opposite end to the closure member 25. These sleeves, which are fastened to the members 41 and 25 by welding, brazing, or other suitable means, provide the only mechanical connection between the head section 10 and heat exchanging section 11.

Figure 9:
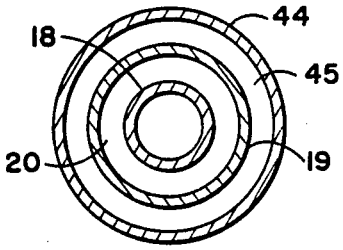
FIG. 9 is a cross-sectional view, taken on line 9—9 of FIG. 8, which shows the structure of the tube bundle at this position in the heat exchanger.

The sleeves 44 enclose that part of each inner tube 18 and outer tube 19 which extends between the distribution member 41 and closure member 25. Since the sleeves 44 have a larger diameter than the outer tube 19, there is a channel 45 defined between the outer surface of tubes 19 and the inner surface of sleeves 44. The size of the enclosing sleeves 44, in relation to the outer conduits 19, is best illustrated in the detail view of FIG. 9. Channel 45 is in fluid communication with the inlet 43 and the insulation material 30. This arrangement enables the cooling fluid which enters through inlet 43, as indicated by numeral 63, to flow through channel 45 and disperse uniformly into the insulation material 30.

In the embodiment illustrated in FIG. 8, the transfer of heat from the heat exchanging section to the head section is considerably reduced, since this embodiment has no wall member which separates the two sections. In addition, the front part of the heat exchanging section is open to the atmosphere, so that the cooling effect of the surrounding environment helps to reduce the amount of heat transfer which takes place. Thermal stresses in this embodiment of the heat exchanger are also minimized by the fact that the outer conduits 19 are secured to the second tube sheet 13 only.

Certain details regarding materials of construction, operating conditions, and other features of the present heat exchanger will now be described. The conduits which carry the lower temperature fluid are made from materials capable of withstanding the temperatures and pressures normally present in the operation of a heat exchanger. For example, in an operation which involves cooling the reaction product of a hydrocarbon cracking reactor, the low temperature fluid will have temperatures of from about 100°–350° C. and pressures of up to 140 atmospheres. Typical of conventional materials which can withstand these conditions are nickel and nickel-based alloys of iron, chromium, cobalt, molybdenum, tungsten, niobium, tantalum, and the like. These metals or metal alloys can also contain non-metal additives, such as silicon and carbon.

The preferred materials for constructing the various parts of the heat exchanger are those which can withstand temperatures and pressures normally encountered in heat exchanging and cleaning operations. When the heat exchanger is employed in cooling the hot reaction products of a hydrocarbon cracking reactor, the temperature and pressure conditions during the heat exchanging operation will be from about 700°–1000° C., and from about with superheated steam, the temperatures will run about 100° C. and the pressure range will be from about 2–10 atmospheres. Suitable materials for withstanding these conditions are nickel and nickel-based alloys.

Since a large portion of the heat in the heat exchanging section is gradually dissipated without being transferred to the head section, the materials of construction for the head section need not be designed to withstand the higher temperatures of the heat exchanging section. For example, the head section is subjected to a maximum temperature of less than 500° C., that is, the maximum temperature to which the second tube sheet is exposed is about 300° C. less than the temperature of the higher temperature fluid entering the heat exchanging section. In general, the preferred materials for constructing the head section are steel alloys of chromium and molybdenum. The size and shape of the heat exchanger and each of its component parts, namely, the conduits, tube sheets, closure member, housings, etc., are determined primarily by the specific operation in which the heat exchanger is employed and the normal conditions of such operation, for example, pressure differentials which exist between one side of the tube sheet and the other side of the same tube sheet. As described earlier, the temperature and pressure conditions change very gradually during operation of the heat exchanger of this invention. For this reason the tube sheets and other components of the exchanger need not be designed to withstand large temperature or pressure differentials.

The invention claimed is:

1. A heat exchanger for cooling a first fluid, at a given temperature and pressure, with a second fluid, at a lower temperature and higher pressure, the heat exchanger comprising:

a head section which includes an inlet and an outlet for the lower temperature fluid;

a heat exchanging section which includes a bundle of inner conduits, each inner conduit is open at both ends, each inner conduit extends from the head section to the heat exchanging section, and each inner conduit is in fluid communication with the inlet for the second fluid, which is the lower temperature fluid, such that the lower temperature fluid can pass through each of the inner conduits;

the heat exchanging section further includes a bundle of outer conduits, each outer conduit is in fluid communication with the outlet for the lower temperature fluid, each outer conduit encloses that part of each inner conduit which lies within the heat exchanging section, such that a channel is defined between the inner surface of the outer conduit and the outer surface of the inner conduit, and the channel provides means for the lower temperature fluid, as it exits from the inner conduits, to flow to the outlet in the head section;

the heat exchanging section further includes an inlet and an outlet for the first fluid, which is the higher temperature fluid, and the heat exchanging section has a space defined therein for the higher temperature fluid to pass from the inlet to the outlet, such that the higher temperature fluid contacts the conduits containing the lower temperature fluid;

the heat exchanger has a temperature adjustment zone defined by an insulation packet, the packet is positioned between the head section and heat exchanging section and enclosed by a closure member and an impingement plate, the closure member is adjacent to a cooling fluid chamber, and the impingement plate is in contact with the higher temperature fluid in the heat exchanging section; and the inner and outer conduits pass through the cooling fluid chamber, the closure member, and the impingement plate, passages are defined between the outer conduits and the closure member, and between the outer conduits and the impingement plate, and the passages provide fluid communication between the cooling fluid chamber and the insulation packet.

2. The heat exchanger of claim 1 which further includes a first tube sheet and second tube sheet, the inner conduits are secured at one end to the first tube sheet, the outer conduits are secured at their open ends to a second tube sheet, and the closure member is located between the second tube sheet and the outlet for the higher temperature fluid.

3. The heat exchanger of claim 2 in which the cooling fluid chamber is defined by a thin surrounding wall which rigidly connects the head and heat exchanging sections, and side walls defined by the second tube sheet and the closure member, and the cooling fluid chamber provides a thermal sleeve which insulates the head section from the heat exchanging section.

* * * * *

UNITED STATES PATENT AND TRADEMARK OFFICE

CERTIFICATE OF CORRECTION

PATENT NO. : 4,889,182

DATED : Dec. 26, 1989

INVENTOR(S) : Peter H. Kosters

It is certified that error appears in the above-identified patent and that said Letters Patent is hereby corrected as shown below:

Col. 9, line 53, after "about" insert --2-10 atmospheres. During the decoking/cleaning cycle,--.

Col. 9, line 54, delete "100°C." and insert --1100°C.--.

Signed and Sealed this

Fifth Day of March, 1991

*Attest:*

HARRY F. MANBECK, JR.

*Attesting Officer*

*Commissioner of Patents and Trademarks*